United States Patent [19]

Kanai

[11] 4,205,254

[45] May 27, 1980

[54] ELECTRON GUN FOR A CATHODE RAY TUBE

[75] Inventor: Hiromi Kanai, Mobara, Japan

[73] Assignee: Hitachi, Ltd., Tokyo, Japan

[21] Appl. No.: 918,810

[22] Filed: Jun. 26, 1978

[30] Foreign Application Priority Data

Jul. 1, 1977 [JP] Japan ..... 52-77922

[51] Int. Cl.[2] ..... H01J 29/04; H01J 29/58

[52] U.S. Cl. ..... 313/454

[58] Field of Search ..... 313/454, 452, 453, 447, 313/448, 446, 455, 411

[56] References Cited

U.S. PATENT DOCUMENTS

| | | | |
|---|---|---|---|
| Re. 27,751 | 9/1973 | Yoshida et al. | 313/411 |
| 2,564,743 | 8/1951 | Wang | 313/454 X |
| 2,817,033 | 12/1957 | Brewer | 313/454 X |
| 2,840,754 | 6/1958 | Linder | 313/453 X |
| 3,881,136 | 4/1975 | Scheele | 313/453 |
| 3,919,583 | 11/1975 | Hasker et al. | 313/448 |

*Primary Examiner*—Palmer C. Demeo

*Attorney, Agent, or Firm*—Charles E. Pfund

[57] ABSTRACT

In an electron gun of a cathode ray tube of the type comprising a cathode electrode for emitting an electron beam, a first grid electrode for focusing the electron beam and a second grid electrode for accelerating the electron beam, the cathode surface which emits the electron beam is a concaved surface which creates different electron beam focusing effects in two orthogonal directions and the first grid electrode comprises a flat plate having an elongated iris opening with its major axis coincided with the direction of the cathode surface in which the focusing effect is strong and the minor axis coincided with the direction of the cathode surface in which the focusing effect is weak.

4 Claims, 4 Drawing Figures

ELECTRON GUN FOR A CATHODE RAY TUBE

BACKGROUND OF THE INVENTION

This invention relates to an electron gun of a cathode ray tube, more particularly a cathode system (that is, a cathode electrode and a first grid electrode) which can produce a small electron beam spot.

The potential distribution and the path of electron beams near the cathode electrode of an electron gun utilized in a cathode ray tube are generally shown by FIG. 1. Although it is difficult to strictly show the behavior of the electrons near the cathode electrode, the electrons 3 emitted from the surface 2 of the cathode electrode 1 are subjected to a force acting in a direction perpendicular to equipotential surfaces 4 so that the electrons form a crossover 5. More particularly, in an electron gun utilized in an ordinary cathode ray tube, the electric field in front of the cathode electrode not only accelerates the electrons but also forms an electron lens. However, due to the aberration of the electron lens, there is a limit for the minimum diameter of the crossover. Generally, unless the crossover diameter is minimized, when the electron gun is used in a cathode ray tube, it is difficult to make small the spot diameter on the fluorescent screen. As shown in FIG. 1, in an ordinary cathode ray tube, there are also provided a first grid electrode 6 applied with a predetermined potential, for example −10 V, for forming an electron lens near its opening 7 (iris) and a second grid electrode 8 supplied with a predetermined potential, for example +500 V, with respect to the cathode electrode for accelerating the electrons emitted from the cathode electrode. Of course, the second grid electrode 8 too is provided with an opening 9 for passing the electron beams. The cathode electrode 1, and the first and second grid electrodes 6 and 8 are spaced from each other and coaxially arranged along the axis of an evacuated envelope, not shown, of the cathode ray tube.

For the purpose of removing such limit, it has been proposed to form a cathode surface 2 as a portion of a cylindrical or spherical surface as shown in FIG. 2 so as to form a cylindrical or spherical potential distribution thereby readily focusing the electron beam 3 generated from the cathode surface 2. In FIG. 2, numeral 6 represents a primary grid electrode concentric with the cathode surface, O the center of the sphere and R the radius thereof. A typical example of the electron gun having the construction described above is the so-called Pierce type electron gun. Different from the cathode system utilizing a flat electrode as the cathode surface, in the cathode system having a cathode surface in the form of a portion of cylindrical or spherical surface, it is necessary to always correctly align the axis of the cathode electrode 1 and the center of the primary grid electrode 6, necessitating troublesome assembling. For this reason, the cathode system of this construction has not been used extensively.

SUMMARY OF THE INVENTION

Accordingly, it is a principal object of this invention to provide an improved electron gun of a cathode ray tube capable of minimizing the aberration of the electron lens and can readily align the centers of the cathode electrode and the first grid electrode.

According to this invention, this object can be accomplished by providing an electron gun of a cathode ray tube comprising a cathode electrode having a surface for emitting an electron beam, a first grid electrode supplied with a first predetermined potential with respect to the cathode electrode, and a second grid electrode supplied with a second predetermined potential with respect to the cathode electrode, the cathode electrode and the first and second grid electrodes being contained in an evacuated envelope of the cathode ray tube and disposed coaxially along the axis of the cathode ray tube with predetermined spacings therebetween, whereby the electron beam is focused by the first grid electrode while being accelerated by the second grid electrode, wherein the cathode surface has a nonplanar form which creates different electron beam focusing effects in two different directions, the first grid electrode takes the form of a flat plate provided with an iris opening for passing the electron beam, and wherein the cathode electrode and the first grid electrode are positioned relatively such that one direction of the iris opening in which the focusing effect is strong coincides with one direction of the cathode surface in which the focusing effect is weak whereas the other direction of the iris opening in which the focusing effect is weak coincides with the other direction of the cathode surface in which the focusing effect is strong.

Advantageously, the cathode surface comprises a portion of a cylindrical surface or a spherical surface and the iris opening of the first grid electrode takes the form of an elongated slot.

DESCRIPTION OF THE PREFERRED EMBODIMENTS

Before describing the invention, the focusing effect of the cathode surface will first be described. Where the cathode surface is concave, when the number of the normals to respective segmental areas of the cathode surface which pass through the center of the cathode surface is large, the focusing effect of the cathode surface upon the electron beam is large. The reason is as follows:

Of course, the path of the electron beam becomes different depending upon the configuration of the first grid electrode or the focusing electrode disposed in front of the cathode surface. However, regardless of the configuration of the focusing electrode, when the normals to the cathode surface are oriented toward the axis of the cathode surface, the electrons emitted by the cathode surface tend to focus at a point near the cathode surface. Accordingly, even for the same cathode surface, the focusing action differs depending upon the direction of the normals to segmental areas of the cathode surface.

Figure 1:
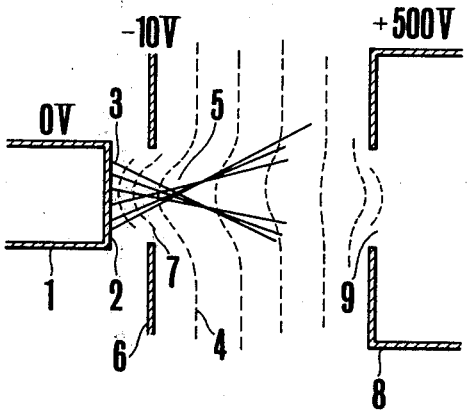
FIG.1 (PRIOR ART)
FIG. 1 is a diagrammatic representation of the potential distribution and the path of the electron beam near the cathode electrode of a prior art electron gun of a cathode ray tube.
Figure 2:
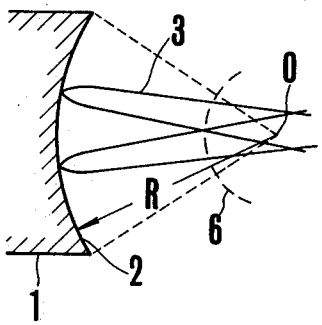
FIG.2 (PRIOR ART)
FIG. 2 is a diagrammatic representation of the electron path of a prior art electron gun having a spherical first grid electrode concentric with the cathode surface.

Let us now consider the magnitude of the focusing action of the first grid electrode. As shown in FIG. 1, the first grid electrode is disposed in front of the cathode electrode 1 and the electron beam is focused when it passes through the iris opening 7 of the fist grid electrode. The smaller this opening, the larger is the focusing action on the electron beam.

Figure 3:
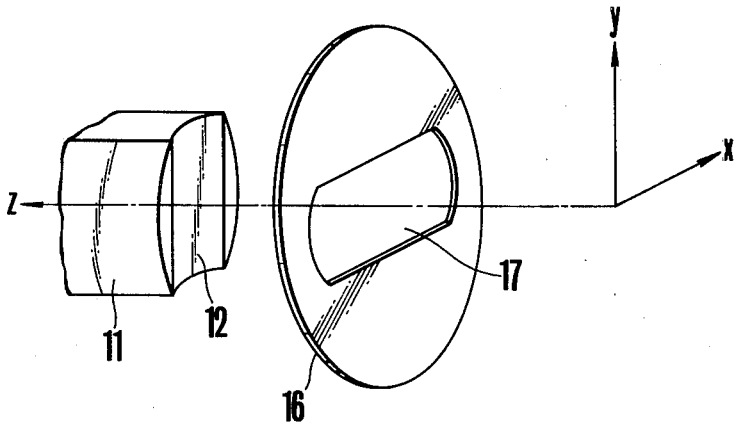
FIG. 3 is a perspective view showing a cathode system of an electrode gun embodying the invention and utilized in a cathode ray tube.

As shown in FIG. 3 which shows the cathode system of this invention, the cathode surface 12 of the cathode electrode 11 takes the form of a portion of a cylindrical surface. Let us denote the direction of flexure of the cathode surface by x and the direction of the axis of the cylinder by y. In connection with segmental areas of the cathode surface lying in the x and y directions which intersect at right angles, the number of normals to these areas which are oriented to Z-axis direction extending through the center of the cathode surface is different. Accordingly, the electron beam focusing effects in these two directions are different. Thus, the focusing effect is large in the direction of x but small in the direction of y. On the other hand, as shown in FIG. 3, the first grid electrode 16 disposed in front of the cathode electrode 1 takes the form of a flat plate and provided with an elongated iris opening 17 which is elongated in the direction of x and symmetrical with respect to the axis of the cathode electrode. Thus, the first grid electrode has a large focusing action upon the electron beam emitted from the cathode electrode in the direction y (because of a narrow width of the iris opening) but a small focusing action in the direction x (because of a wide width). Since the first grid electrode takes the form of a flat plate, it is easy to correctly dispose it with respect to the cathode electrode.

In the cathode system shown in FIG. 3, the electron beam is subjected to a strong focusing action in the direction of x by the specific configuration of the cathode surface 12 and to a strong focusing action in the direction of y by the first grid 16 so that the electron beam forms a suitable crossover. Since the cathode surface is cylindrical, the crossover is formed such that it decreases the aberration of the electron lens. The combination of cathode and grid electrodes 11 and 16 does not affect the quality of crossover even when the relative position between the cathode electrode 11 and the first grid electrode 16 constructed as described above is not strictly aligned in the x or y direction. Accordingly, the assembling of the electron gun is easy.

Figure 4:
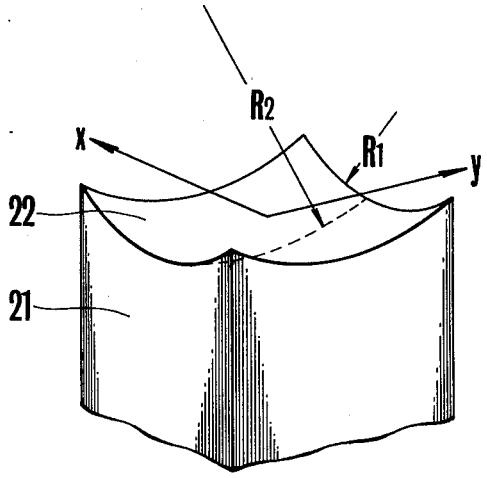
FIG. 4 is a fragmentary perspective view showing a modified cathode electrode embodying the invention.

While, in the embodiment shown in FIG. 3, x and y directions intersect at right angles, the x and y directions may intersect at an angle different from 90°. So long as the cathode surface is nonplanar that can decrease the aberration of the electron lens, any other configurations may be used. For example, as shown in FIG. 4 the cathode surface 22 may take a saddle form having a radius of curvature $R_2$ in the y axis direction and a radius of curvature $R_1$ in the x axis direction, where $R_1 < R_2$, and $R_1$ and $R_2$ may have any lengths. This cathode surface 22 has a strong focusing action in the direction x having smaller radius $R_1$ whereas a weak focusing action in the direction y perpendicular to direction x. Where the cathode electrode 21 having the cathode surface 22 described above is used, the accuracy of the relative position of the cathode electrode 21 and the first grid electrode (not shown) in front thereof is not required to be strict so that the assembling operation becomes easy as in the preceding embodiment.

When the direction in which the focusing action of the cathode surface of the cathode electrode shown in FIG. 3 or 4 is aligned with a direction which is perpendicular to the scanning line of the cathode ray tube, the resolution of the picture can be improved.

What is claimed is:

1. In an electron gun of a cathode ray tube comprising a cathode electrode having a surface for emitting an electron beam, a first grid electrode supplied with a first predetermined potential with respect to said cathode electrode, and a second grid electrode supplied with a second predetermined potential with respect to said cathode electrode, said cathode electrode and said first and second grid electrodes being contained in an evacuated envelope of said cathode ray tube and disposed coaxially along an axis of said cathode ray tube with predetermined spacing therebetween, whereby said electron beam is focused by said first grid electrode while being accelerated by said second grid electrode, the improvement wherein said cathode surface has a nonplanar form which creates different electron beam focusing effects in two different directions, said first grid electrode takes the form of a flat plate provided with an iris opening for passing said electron beam, and wherein said cathode electrode and said first grid electrode are positioned relatively such that one direction of said iris opening in which the focusing effect is strong coincides with one direction of said cathode surface in which the focusing effect is weak whereas the other direction of said iris opening in which the focusing effect is weak coincides with the other direction of said cathode surface in which the focusing effect is strong.

2. The electron gun according to claim 1 wherein said two different directions intersect at right angles, and said iris opening comprises a rectangular opening which is symmetrical with respect to said axis, the major axis direction of said rectangular opening corresponds to said other direction in which the focusing effect is strong whereas the minor axis direction corresponds to said one direction in which the focusing effect is weak.

3. The electron gun according to claim 1 or 2 wherein said nonplanar form takes the form of a portion of a cylindrical surface having an axis in which the focusing effect is weak.

4. The electron gun according to claim 3 wherein said cylindrical surface has a curvature in the x axis direction of radius $R_1$ and a curvature in the y axis direction of radius $R_2$, where $R_1 < R_2$, thus forming a saddle shaped cathode surface.

* * * * *